United States Patent [19]

Wilkes et al.

[11] 4,292,801

[45] Oct. 6, 1981

[54] DUAL STAGE-DUAL MODE LOW NOX COMBUSTOR

[75] Inventors: Colin Wilkes, Scotia; Milton B. Hilt, Sloansville, both of N.Y.

[73] Assignee: General Electric Company, Schenectady, N.Y.

[21] Appl. No.: 56,510

[22] Filed: Jul. 11, 1979

[51] Int. Cl.[3] ..... F23R 3/34

[52] U.S. Cl. ..... 60/39.06; 60/733; 60/747

[58] Field of Search ..... 60/39.06, 732, 733, 60/737, 746, 747

[56] References Cited

U.S. PATENT DOCUMENTS

| | | | |
|---|---|---|---|
| 2,999,359 | 9/1961 | Murray . | |
| 3,048,014 | 8/1962 | Schmidt . | |
| 3,946,553 | 3/1976 | Roberts et al. . | |
| 3,958,413 | 5/1976 | Cornelius et al. . | |
| 3,958,416 | 5/1976 | Hammond et al. . | |
| 3,973,395 | 8/1976 | Markowski et al. | 60/733 |
| 4,173,118 | 11/1979 | Kawaguchi et al. | 60/733 |
| 4,193,260 | 3/1980 | Carlisle et al. | 60/737 |

FOREIGN PATENT DOCUMENTS 2613589 10/1976 Fed. Rep. of Germany ..... 60/733

OTHER PUBLICATIONS

Carlstrom et al., "Improved Emissions Performance in Today's Combustion Systems", Intl. Gas Turb. Seminar, Jun. 1978, pp. 17, 18.

*Primary Examiner*—Robert E. Garrett
*Attorney, Agent, or Firm*—Jerome C. Squillaro

[57] ABSTRACT

An improved dual stage-dual mode combustor capable of reduced emissions of nitrogen oxide from a combustion turbine is disclosed. The combustor includes two combustion chambers separated by a throat region. Fuel is initially introduced and ignited in the first chamber. Thereafter, fuel is introduced near the downstream end of the first chamber for ignition and burning in the second chamber. Burning in the first chamber is extinguished by shifting the fuel flow to burning in the second chamber and after termination of the flame in the first chamber, fuel is reintroduced into the first chamber for premixing only with burning in the second chamber. By selectively controlling the percentage of fuel introduced into the first stage, low emissions of nitrogen oxide are realized.

19 Claims, 8 Drawing Figures

DUAL STAGE-DUAL MODE LOW NOX COMBUSTOR

BACKGROUND OF THE INVENTION

The present invention relates to combustors for combustion turbines and more particularly to combustors capable of reduced emissions of nitrogen oxides, NOx.

It is known that NOx formation increases with increasing flame temperature and with increasing residence time in the combustor. It is therefore theoretically possible to reduce NOx emissions from a combustor by reducing the flame temperature and/or the time at which the reacting gases remain at the peak temperatures. In practice, however, this is difficult to achieve because of the turbulent diffusion flame characteristics of present day combustion turbine combustors. In such combustors, the combustion takes place in a thin layer surrounding the evaporating liquid fuel droplets at a fuel/air equivalence ratio near unity regardless of the overall reaction zone equivalence ratio. Since this is the condition which results in the highest flame temperature, relatively large amounts of NOx are produced. As a result, the conventional single stage, single fuel nozzle spray atomized combustors may not meet newly established emission standards regardless of how lean the nominal reaction zone equivalence ratio is maintained.

It is also known that significant reductions in NOx emissions can be achieved by injection of water or steam into the combustor reaction zone. However, such injection has many disadvantages including an increase in system complexity and high water treatment costs.

The problem of realizing low NOx emissions develops further complexity where it is necessary to meet other combustion design criteria. Among such criteria are those of good ignition qualities, good crossfiring capability, stability over the entire load range, large turndown ratio, low traverse number, long life and ability to operate safely and reliably.

Factors which result in the formation of NOx from fuel bound nitrogen and air nitrogen are known and efforts have been made to adapt various combustor structures in light of these factors. For example, U.S. Pat. Nos. 2,999,359; 3,048,014; 3,946,533; 3,958,413; 3,958,416 and 3,973,395 describe various combustor structures for use in combustion turbines. These combustors, however, have either not been adaptable for use on stationary combustion turbines or have been inadequate for other reasons such as cost, complexity, unreliability or unacceptable performance characteristics.

In copending patent application Ser. No. 3,016 filed Jan. 12, 1979 by R. A. Farrell et al and of common assignee, a dual stage low NOx combustor for a stationary combustion turbine is described. This application contains subject matter related to the Farrell et al application and the invention described herein is an improvement upon that invention.

It is an object of this invention to provide a dual stage low NOx combustor for a stationary combustion turbine which operates over the entire turbine cycle with substantially reduced pollutant emissions, principally NOx and carbon monoxide. It is a further object of this invention to provide a method and apparatus for producing low emissions of NOx and carbon monoxide from a combustion turbine combustor characterized by good ignition and crossfiring qualities, stability over the load range, large turndown ratio, low traverse number, long life and safe and reliable operation. Other objects and advantages of the present invention will become apparent to those skilled in the art from the following detailed description taken in conjunction with the accompanying drawings.

SUMMARY OF THE INVENTION

The present invention relates to a method and apparatus for achieving a significant reduction in NOx emissions from a combustion turbine without aggravating ignition, unburnt hydrocarbon or carbon monoxide emission problems. More particularly, the low NOx combustor of the present invention includes a first and second combustion chambers or stages interconnected by a throat region. Fuel and mixing air are introduced into the first combustion chamber for premixing therein. The first chamber includes a plurality of fuel nozzles positioned in circumferential orientation about the axis of the combustor and protruding into the first stage through the rear wall of the first chamber. Additional fuel and air is introduced near the downstream end of the first combustion chamber as well as additional air in the throat region for combustion in the second combustion chamber. The combustor is operated by first introducing fuel and air into the first chamber for burning therein. Thereafter, the flow of fuel is shifted into the second chamber until burning in the first chamber terminates, followed by a reshifting of fuel distribution into the first chamber for mixing purposes with burning in the second chamber. The combustion in the second chamber is rapidly quenched by the introduction of substantial amounts of dilution air into the downstream end of the second chamber to reduce the residence time of the products of combustion at NOx producing temperatures thereby providing a motive force for the turbine section which is characterized by low amounts of NOx, carbon monoxide and unburned hydrocarbon emissions.

DETAILED DESCRIPTION OF THE INVENTION

Figure 1:
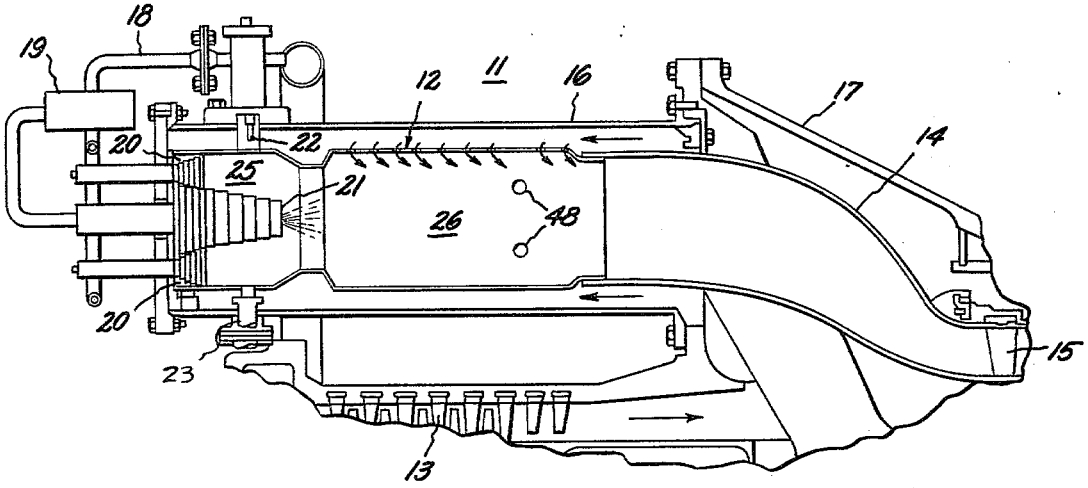
FIG. 1 is a partial cross-sectional view of a combustion turbine combustor in accordance with a preferred embodiment of the present invention.

FIG. 1 illustrates a portion of a combustion turbine 11 including a low NOx combustor 12 in accordance with the present invention. Combustion turbine 11 is typically of circular cross-section having a plurality of combustors 12 which are spaced around the periphery of the combustion turbine. The turbine also includes a compressor 13 which provides high pressure air for combustion and cooling. During operation of the turbine 11, combustor 12 burns fuel (as will be described hereinafter) with high pressure air from the compressor 13, adding energy thereto, and a portion of the energy of the hot gases leaves the combustor 12 through a transition member 14 to the first stage nozzles 15 and turbine blades (not shown) mounted to the turbine wheel which drives the compressor 13 and a suitable load.

The low NOx combustor 12 is enclosed within a combustion liner 16 secured to the turbine casing 17. Fuel is brought to the turbine 11 via a fuel line 18 and fuel flow controller 19 which introduces the fuel into the combustor 12 through suitable fuel introduction means 20 and 21, such as fuel nozzles. The fuel introduction means 20 and 21 can be adapted to accept either gaseous or liquid fuels or by the use of a dual fuel nozzle, such as those described in U.S. Pat. No. 2,637,334 issued to N. E. Starkey and U.S. Pat. No. 2,933,894 issued to R. M. Johnson and A. Loft, the combustor can be operated with either fuel. The fuel is ignited by well known ignition means, such as a spark plug 22 with ignition between adjacent combustors assured by the use of crossfire tubes 23.

Figure 2:
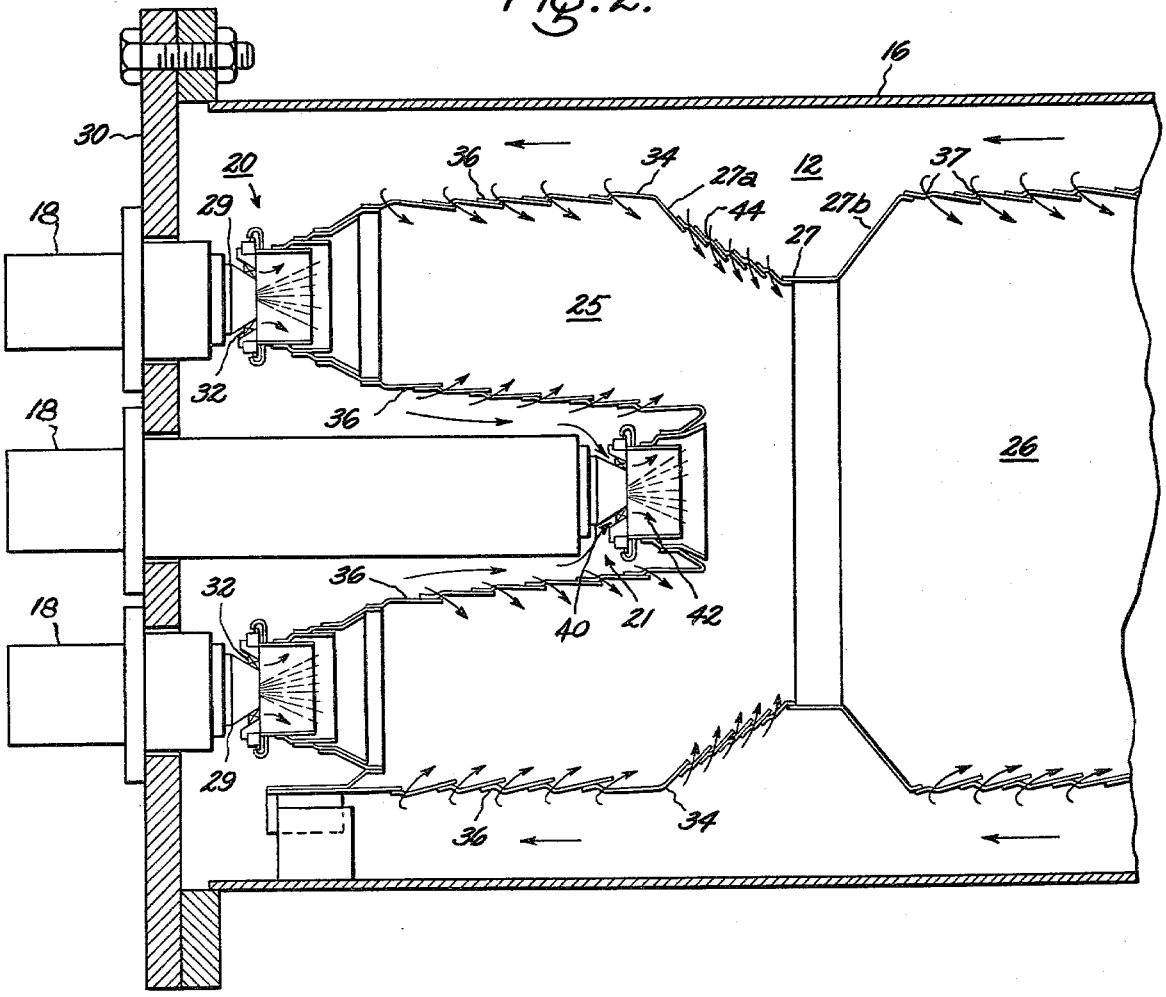
FIG. 2 is a schematic cross-sectional view illustrating in greater detail the first and second stages of the dual stage combustor interconnected by a throat region.

FIG. 2 illustrates in greater detail the low NOx combustor 12 of the present invention as including a first stage or chamber 25 and a second stage or chamber 26 in which the upstream end of the second chamber is interconnected with the downstream end of the first chamber by a throat region 27 of reduced cross-section.

Combustion chambers 25 and 26 are preferably of circular cross-section, although other configurations can be employed. The material of construction is preferably a high temperature metal which can withstand the firing temperatures typically encountered in a combustion turbine combustor. Cooling of the combustion chambers is preferably provided by air film cooling utilizing louvers such as described in U.S. Pat. No. 3,777,484 of Dibelius and Schiefer or slots such as described in U.S. Pat. No. 3,728,039 of Corrigan and Plennums. However, other cooling arrangements such as water cooling, closed system cooling, steam film cooling and conventional air film cooling may be utilized, if desired.

Figure 3:
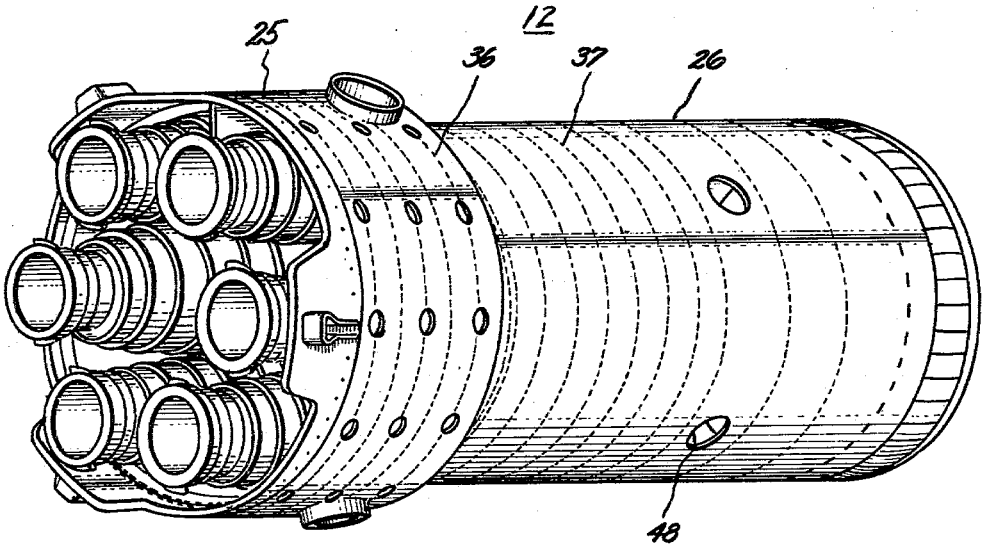
FIG. 3 is a perspective view of the exterior of the dual stage combustor constructed in accordance with the present invention.

Fuel introduction means 20 are illustrated in FIGS. 2 and 3 as comprising a plurality of fuel nozzles 29 and include six nozzles positioned in circumferential orientation about the axis of the combustor 12. The fuel nozzles 29 protrude into the first stage combustor 25 through the rear wall 30. Fuel is conveyed to each fuel nozzle 29 through fuel lines 19 which extend beyond the rear wall 30. Combustion air is introduced into the first stage through air swirlers 32 positioned adjacent the outlet end of the nozzles 29. The fuel swirlers 32 introduce swirling combustion air which mixes with the fuel from the fuel nozzles 29 and provides an ignitable mixture for combustion. Combustion air for the air swirlers 32 is derived from the compressor 13 and the routing of air between the combustion liner 17 and the wall 34 of the combustion chamber.

In accordance with the present invention, FIG. 2 illustrates a plurality of spaced louvers 36 along the walls 34 of the first combustion chamber 25 and a plurality of louvers 37 along the walls of the second combustion chamber 26 for cooling purposes, as described above, and for introducing dilution air into the combustion zone to prevent substantial rises in flame temperature as will be described more fully below.

The first combustion chamber 25 also includes fuel introduction means 21 including a fuel nozzle 40, which may be similar to fuel nozzles 29 and which extends from the rear wall 30 of the combustor toward the throat region 27 so that fuel may be introduced into the second combustion chamber 26 for burning therein. An air swirler 42 similar to air swirlers 32 is provided adjacent the fuel nozzle 40 for introducing combustion air into the fuel spray from the fuel nozzle 40 to provide an ignitable fuel-air mixture.

The throat region 27 which interconnects the first and second combustion chambers functions as an aerodynamic separator or isolator for the prevention of flashback from the second chamber to the first chamber. In order to perform this function, the throat region 27 is of reduced diameter relative to the combustion chambers. In general, it has been found that a ratio of the smaller of the first combustion chamber 25 or the second chamber 26 diameter to the throat region 27 diameter should be at least 1.2:1 and preferably about 1.5:1. However, larger ratios may be required or necessary to prevent flashback since a further factor affecting flashback is the location of the fuel introduction means 21 relative to the location at the throat region 27. More specifically, the closer the fuel introduction means 21 is to the throat region 27, the smaller the ratio of diameters may be without experiencing flashback. In view of the foregoing discussion, those skilled in the art can appreciate that the location of the fuel introduction means 21 relative to the throat region 27 and the dimensions of the throat region relative to the combustion chambers can be optimized for minimum flashback by simple experimentation.

The throat region 27 is also contoured to provide a smooth transition between the chambers by a wall region **27*a* of uniformly decreasing diameter (converging) and a wall region 27*b* of uniformly increasing diameter (diverging). Additionally, the walls of the throat region 27 also include slots 44 for the introduction of compressed air, which not only provides wall cooling but also reduces the possibility of flashback into the first chamber by providing a constant flow of air into the second chamber in the region where flashback is most likely to be initiated. Additionally, dilution holes 48 (illustrated in FIGS. 1 and 3**) provide for the rapid introduction of dilution air into the second combustion zone to prevent substantial rises in flame temperature in a manner more fully described below.

Figure 4:
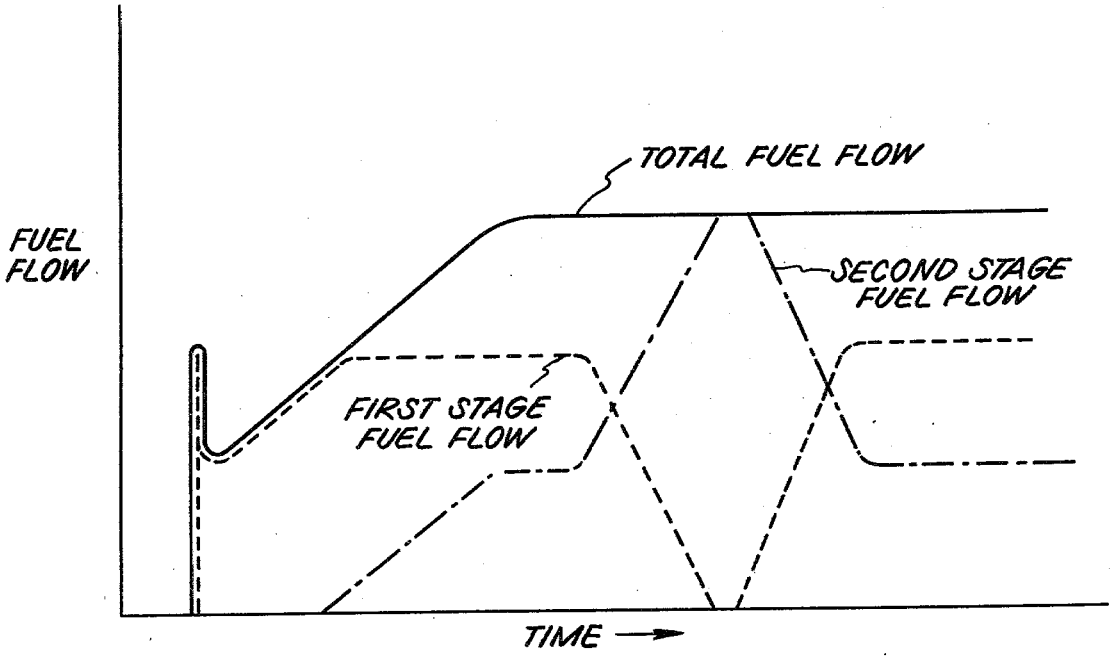
FIG. 4 is a graph illustrating the fuel flow in the operation of the dual stage combustor as a function of time.

Operation of the low NOx combustor 12 can be readily understood from the following description taken in connection with FIG. 4. During startup, combustion begins by igniting a mixture of hydrocarbon fuel, such as #2 distillate, by means of spark plug 22 and crossfire tubes 23. During ignition and crossfiring, and also during low load operation of the combustor, fuel flow controller 19 permits fuel to flow to only the fuel nozzles 29 in the first combustion chamber 25. Up to this point, combustion is a single-stage heterogenous, turbulent diffusion flame burning characteristic of conventional combustors.

At some mid-range load condition, exact timing of which is related to stability limits and the pollution emission characteristic of each mode, fuel is split between the fuel nozzles 29 and 40 by the fuel flow controller 19 and fuel is introduced into the second chamber for burning therein by fuel nozzle 40. At this point, fuel is burning in both the first chamber 25 and the second chamber 26. The combustor, therefore, is operating in a two-stage heterogenous mode which continues until a desired load is achieved. After allowing a short period for stabilization and warm up, the operation is converted from a two stage heterogenous combustion to a single stage combustion. This procedure begins by simultaneously increasing the amount of fuel to the fuel nozzle 40 while decreasing the amount of fuel to the nozzles 29, the total fuel flow remaining constant. The change in fuel distribution continues until the flame goes out in the first combustion chamber 25, which in most instances, is when all of the fuel has been transferred to nozzle 40.

Fuel flow to nozzles 29 is then reinitiated and flow to nozzle 40 is decreased while maintaining the total fuel flow substantially constant. The switch of fuel distribution from nozzle 40 to nozzles 29 continues until the desired low pollutant emission levels are met. In general, the reduced pollutant emission levels are achieved when the majority of fuel flow is equally distributed between the plurality of fuel nozzles 29 and only 10–25% of the total fuel flows through nozzle 40.

In this mode of operation, the majority of the fuel and air are premixed in the first combustion chamber 25 and combust homogenously in the second combustion chamber 26. The reintroduction of ignition back into the first combustion chamber 25, referred to as flashback, is prevented under normal operation by the introduction of air, as desribed previously, in the throat region through slots 44. It should be appreciated that an important feature of the combustor of the present invention is that if flashback should occur, it is not a hardware catastrophe as in typical premixed designs. However, a significant increase in NOx emissions would occur and the above procedure of switching from a heterogenous to a homogenous mode would be required to resume operation in the homogenous mode.

Shutdown of the gas turbine is achieved by reestablishing ignition in the first combustion chamber 25 since there is only a small turndown ratio when combustion is occuring in the second combustion chamber only. Relighting of the first combustion chamber means that there is a return to the heterogenous two-stage combustion where the system has a wide turndown ratio, allowing the turbine to be brought down slowly so as to alleviate undesirable thermal stresses.

Figure 5:
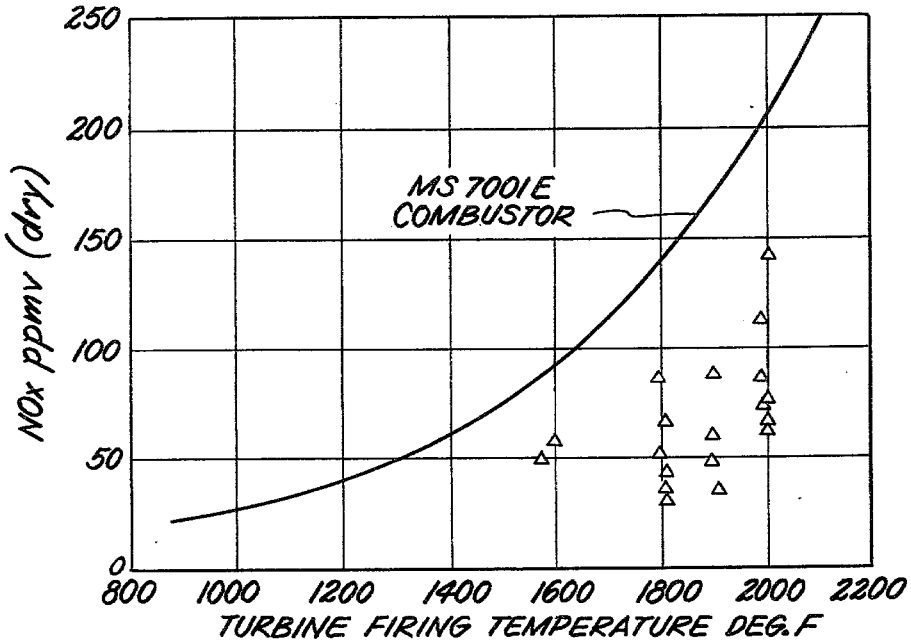
FIG. 5 is a graph illustrating typical NOx emissions as a function of turbine firing temperature for a conventional combustor and a dual stage combustor with differing amounts of fuel flow in the first stage.
Figure 6:
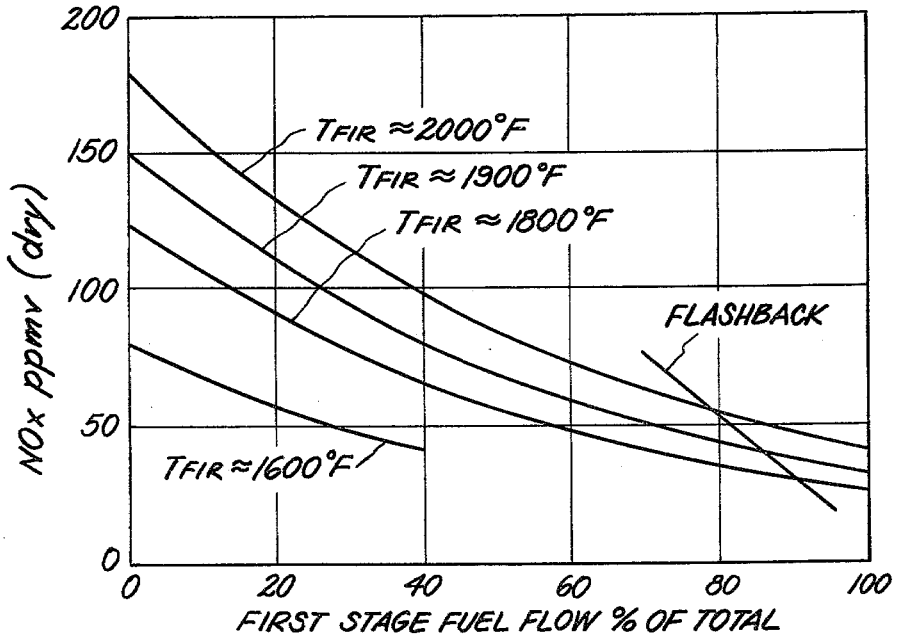
FIG. 6 is a graph illustrating typical NOx emissions as a function of the percentage of fuel flow in the first stage at constant firing temperatures.

In order to demonstrate the reduction in NOx emissions achieved by the present invention, a combustor constructed in accordance with the present invention was compared to a conventional commercially available combustor for the MS 7001E combustion turbine. For these tests, the combustor had the configuration illustrated in FIGS. 1 through 3 and utilized air atomized fuel nozzles for the nozzles 29 and 40. Data was collected on NOx emissions as a function of turbine firing temperature utilizing nonvitiated air (indirectly heated air) for the combustion process. This data is plotted in FIG. 5 along with the conventional MS 7001E combustor NOx emission characteristic. FIG. 5 clearly illustrates a substantial reduction in NOx emission from 1600° to 2000° F. when compared with the conventional combustor. The differences in NOx emission at each of the firing temperatures illustrates different percentages of first stage fuel flow. FIG. 6 more clearly illustrates the substantial reduction in NOx emissions as a function of first stage fuel flow for constant turbine firing temperatures.

The test data plotted in FIGS. 5 and 6 for the combustor illustrated in the drawings were found to have a NOx characteristic which varied with firing temperature ($T_{FIR}$) and fuel flow split (FS) between the plurality of nozzles 29 and the nozzle 40 which can be summarized by the following equation:

$$NOx = EXP(A + B(T_{FIR}) + C(FS) + D(T_{FIR})(FS))$$

The constants A, B, C and D in the equation are dependent upon the number and location of the cooling and dilution holes in the combustor. A typical combustor configuration, such as that illustrated in FIG. 3 has the following constant values:

A = 1.079
B = 0.0021
C = −0.0202
D = 2.72E-06

Using the foregoing equation with the above constants, it is possible to calculate the expected NOx emissions over a wide range of operating conditions. It is not possible, however, to run at a fuel split of 100% in the first combustion stage due to the occurrence of flashback. As pointed out previously, when flashback occurs, the first stage changes from a premixing stage to operation with combustion in the first stage. While the exact percent of fuel split which causes flashback is not clearly defined and further varies with firing temperature and combustor configuration, FIG. 6 illustrate a typical flashback characteristic for the combustor of FIG. 3.

From the foregoing discussion and the data of FIGS. 5 and 6, it is readily apparent that it is desirable to maximize the fuel flow into the first combustion chamber 25 to enhance premixing and thereby decrease NOx emissions. However, it is apparent from FIG. 6 that increasing firing temperatures may cause flashback unless fuel flow is reduced to the first combustion stage. However, it can be readily appreciated that approximately 75 to 90% of the fuel may be premixed in the first combustion chamber before flashback occurs. Under these conditions, NOx emissions are substantially less than those of the conventional combustor illustrated in FIG. 5.

Figure 7:
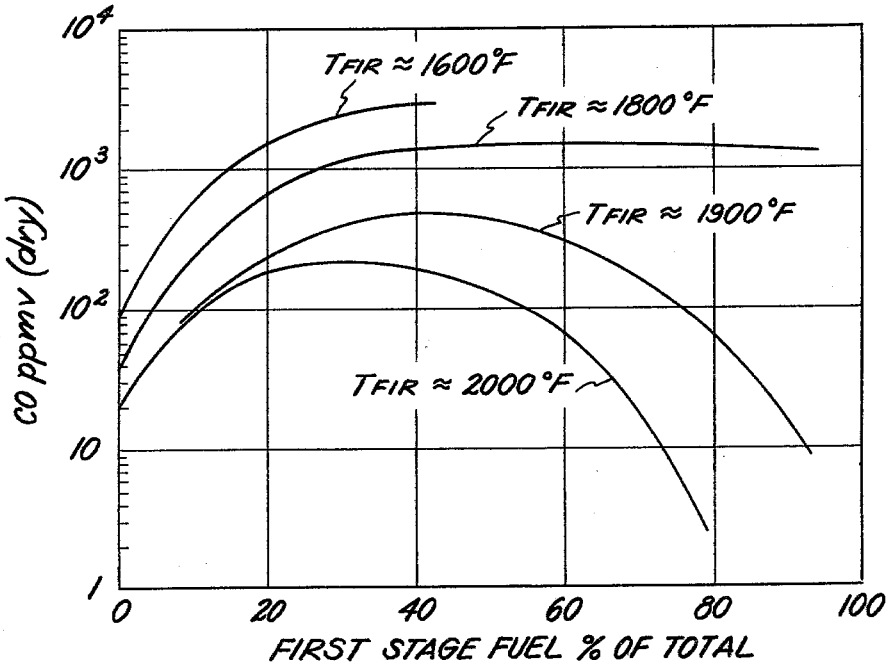
FIG. 7 is a graph illustrating typical carbon monoxide emissions as a function of the percentage of fuel flow in the first stage at constant firing temperatures.

FIG. 7 illustrates the carbon monoxide (CO) emissions from the combustor of FIG. 3 as a function of fuel flow in the first combustion chamber. While the CO emissions are approximately an order of magnitude or more higher at low firing temperatures, the CO emissions are of the same order of magnitude at higher firing temperatures as they are with the conventional combustor. Accordingly, the combustor of the present invention provides both low NOx and low CO emissions at typical combustion turbine base load firing temperatures.

Figure 8:
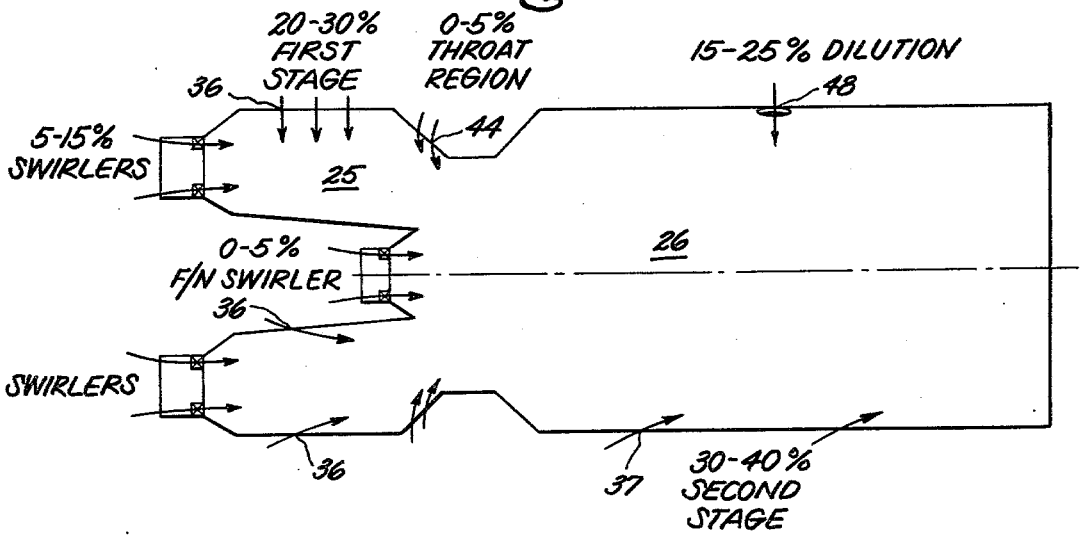
FIG. 8 is an illustration of the air flows in a typical dual stage combustor constructed in accordance with the present invention.

In order to operate the combustor of the present invention with low NOx and CO emissions, it is necessary to not only maintain the proper fuel flow split between the nozzles 29 and 40 but also to maintain the proper air flow into each of the combustion chambers. Since the air flow into these chambers is fixed by the design and not variable in operation, it is desirable to design the combustor with the airflows illustrated in FIG. 8. For example, airflow is preferably between approximately 5 and 15% for all the air swirlers 32, between approximately 0 and 5% for the air swirlers 42, between approximately 20 and 30% through louvers 36, between approximately 30 and 40% for the slots 37, between approximately 15 and 25% for the dilution holes 48 and between approximately 0 and 5% for the louvers 44 in the throat region 27. In this way, approximately 25 to 50% of the air is introduced into the first combustion chamber, 45 to 65% in the second combustion chamber and up to 5% in the throat region 27 to minimize the occurrence of flashback. Also, it should be noted that a substantial amount of air, between 15 and 25%, is introduced into dilution holes 48 to reduce the residence time of the products of combustion at Nox producing temperatures. As a result, the hot gases exiting from the second combustion chamber 26 into the transition member 14 include low quantities of NOx and carbon monoxide.

From the foregoing discussion of the test data, those skilled in the art can appreciate the significant reduction (a factor of 4 or more) in NOx emissions achieved by the combustor constructed in accordance with the present invention. By utilizing such combustors, NOx emission levels will be substantially reduced and will meet most NOx emission requirements.

Having thus described a preferred embodiment of the present invention and its operation, those skilled in the art can better understand how the inventon is distinguishable from the aforementioned prior art patents. For example, U.S. Pat. No. 2,999,359 to Murray appears to relate to a combustor which introduces fuel and air into a first region for premixing and burning and introduction of fuel into a second region for burning downstream of the first region. Both the structure and mode of operation of this combustor are substantially different from that described and claimed herein. For example, the combustor of the present invention utilizes two stages separated by a throat region including a plurality of nozzles in the first combustion chamber with no burning in the first chamber except during start up and shutdown.

U.S. Pat. No. 3,973,395 to Markowski et al appears to relate to a low emission combustor utilizing a plurality of premixing stages and a main combustion stage. However, like the Murray patent, applicants' invention differs both structurally and operationally from this patent.

U.S. Pat. No. 3,946,533 to Roberts et al appears to describe a combustor with two stages and multiple fuel nozzles for emission control. However, the fuel and air are mixed outside the combustion liner wall which is distinguishable from the invention described herein. Also, in accordance with the combustor of the present invention, there are conditions where the reaction occurs in an unpremixed heterogenous mode (i.e., during start up, part load and transient periods of base load), a mode of operation not possible in the combustor of the Roberts et al patent. The modes of operation of the present invention facilitate a large turndown ratio, easy ignition and crossfiring, and flame stability, essential characteristics of a practical combustor design. Also, switching from the heterogenous to the premix mode of operation is achieved in accordance with the present invention by varying the fuel split between the first and second combustion stages, a characteristic not disclosed by Roberts et al.

U.S. Pat. No. 3,958,413 to Cornelius et al and No. 3,958,416 to Hammond, Jr. et al relate to two-stage combustors with the stages separated by a converging, diverging throat section. Also, the first stage of both of these patents is used at some times during the cycle as a section where combustion occurs and at other times in the cycle where premixing occurs. Therefore, flashback does not cause a hardware catastrophe as would be the situation in the Roberts et al patent. However, the Cornelius et al and Hammond, Jr. et al patents appear to describe a variable air inlet geometry for changing the air scheduling between stages to accomplish the transition from what appears to be a heterogenous combustion in the first stage or in the first and second stages to homogenous combustion in the second stage only. In contradistinction, the present invention utilizes fuel scheduling between stages, utilizing multiple fuel nozzles (rather than variable geometry) and varying the fuel split rather than the air split.

In summary, a low NOx combustor for a stationary combustion turbine is described which operates reliably over the entire turbine cycle with substantially reduced pollutant emissions, principally NOx and CO.

While the invention has been described with respect to a specific embodiment, those skilled in the art can readily appreciate the various changes and modifications thereof may be made within the spirit and scope of this invention. Accordingly, the claims are intended to cover all such modifications and variations.

What is claimed is:

1. A method of operating a gas turbine combustor to achieve low emissions of nitrogen oxide, said combustor including first and second combustion stages separated by a throat region of reduced diameter relative to said combustion stages with a plurality of fuel nozzles and air swirlers for introducing fuel and air respectively into said first stage and a single fuel nozzle and air swirler positioned adjacent said throat region for introducing additional fuel and air respectively into said second stage, said method comprising:

introducing fuel and air into said first stage from said plurality of fuel nozzles and air swirlers for mixing therein to create a combustible fuel-air mixture;

introducing additional fuel and air into said second stage from said single fuel nozzle and air swirler, said additional fuel and air mixing with the combustible fuel-air mixture in said second stage for combustion therein and wherein the step of introducing additional fuel and air into said second stage from said single fuel nozzle and air swirler includes locating said single fuel nozzle and air swirler relative to said throat region and dimensioning said throat region relative to said combustion stages to minimize flashback from said second combustion stage to said first combustion stage;

introducing additional air into said second stage from said throat region for further reducing the possibility of flashback into said first stage from said second stage;

introducing dilution air into the downstream end of said second stage to reduce residence time of the products of combustion at NOx producing temperatures in said second stage; and adjusting the fuel flow to said single fuel nozzle and said plurality of fuel nozzles while maintaining a substantially constant total fuel flow until a majority of the total fuel flow is equally distributed among said plurality of fuel nozzles.

2. The method of claim 1 wherein between approximately 75 and 95% of the total fuel flow is introduced into said first stage.

3. The method of claim 1 wherein said first and second stages include walls having a plurality of openings therein and introducing compressed air into said first and second stages through said plurality of openings.

4. The method of claim 3 further comprising the step of introducing between approximately 25 and 50% of the total air to said combustor into said first stage.

5. The method of claim 4 wherein approximately 15 to 25% of the total flow in said combustor is introduced as dilution air into the downstream end of said second stage.

6. The method of claim 3 further comprising the step of introducing between approximately 45 to 65% of the total air to said combustor into said second stage.

7. The method of claim 5 wherein the additional air introduced into said throat region is up to approximately 5% of the total airflow to said combustor.

8. The method of claim 1 further comprising the step of conveying the products of combustion from said second stage to said turbine.

9. A low NOx combustor for a gas turbine comprising:

first and second combustion chambers interconnected by a throat region, said throat region being of reduced dimensions compared to said combustion chambers and including gradual converging and diverging sections and functioning as an aerodynamic separator or isolator for minimizing flashback from the second chamber to the first chamber;

first fuel introduction means adjacent the upstream end of said first chamber for introducing fuel therein, said first fuel introduction means comprising a plurality of fuel nozzles circumferentially positioned along the rear wall of said first combustion chamber and projecting into said first chamber;

first means adjacent the pluarlity of fuel nozzles of said first fuel introduction means for introducing compressed air into said first chamber for mixing with said fuel and creating a combustible fuel-air mixture therein;

second fuel introduction means located centrally of said first fuel introduction means for introducing fuel into said second chamber for mixing with the fuel-air mixture or combustion products from said first chamber for burning in said second chamber, said centrally located second fuel introduction means being positioned relative to the downstream end of said first chamber and said throat region for further minimizing possible flashback from said second combustion chamber to said first combustion chamber;

second means adjacent said second fuel introduction means for introducing compressed air into said combustion chamber for mixing with said fuel; and means for introducing dilution air into the downstream end of said second chamber to reduce residence time of the products of combustion at NOx producing temperatures in said second chamber.

10. The low NOx combustor of claim 9 further comprising: p1 means for altering the relative rates of fuel flow between said first and second fuel introduction means.

11. The low NOx combustor of claim 10 wherein the fuel flow into said first combustion chamber is greater than into said second combustion chamber.

12. The low NOx combustor of claim 11 wherein between approximately 75 and 95% of the total fuel flow to said combustor is introduced into said first combustion chamber.

13. The low NOx combustor of claim 9 wherein the compressed air introduced into said first combustion chamber is between approximately 25 and 50% of the total air introduced into said combustor.

14. The low NOx combustor of claim 9 wherein said throat region further includes means for the introducing compressed air into said second combustion chamber for further reducing the possibility of flashback.

15. The low NOx combustor of claim 14 wherein said compressed air introduced into said second combustion chamber from said throat region comprises up to approximately 5% of the total air introduced into said combustor.

16. The low NOx combustor of claim 15 wherein the airflow to said combustor comprises approximately 5 to 15% introduced by said first means, 15 to 25% introduced as dilution air in said second combustion chamber and the balance through louvers or slots in the walls of said first and second combustion chambers.

17. The low NOx combustor of claim 9 wherein approximately 15 to 25% of the total air flow to said combustor comprises said dilution air.

18. The low NOx combustor of claim 13 wherein the compressed air introduced into said second combustion chamber is between approximately 45 and 65% of the total air introduced into said combustor and the balance is introduced in said throat region.

19. The low NOx combustor of claim 9 wherein said second fuel introduction means includes a single fuel nozzle supported from the rear wall of said first combustion chamber.

* * * * *